United States Patent [19]

Rowekamp

[11] Patent Number: 4,535,906

[45] Date of Patent: Aug. 20, 1985

[54] BOTTLE

[75] Inventor: Patricia A. Rowekamp, Cincinnati, Ohio

[73] Assignee: The Drackett Company, Cincinatti, Ohio

[21] Appl. No.: 615,972

[22] Filed: Jun. 1, 1984

[51] Int. Cl.[3] ..... B65D 51/18

[52] U.S. Cl. ..... 215/329; 215/334; 220/288

[58] Field of Search ..... 215/329, 334, 228; 220/288, 293, 296

[56] References Cited

U.S. PATENT DOCUMENTS

| | | | |
|---|---|---|---|
| Re. 31,496 | 1/1984 | Keeler | 215/252 |
| D. 176,226 | 11/1955 | Morris . | |
| D. 223,438 | 4/1972 | Lluch | D9/169 |
| D. 235,032 | 4/1975 | Atkins | D9/44 |
| D. 244,176 | 5/1977 | Pardo | D9/156 |
| D. 250,248 | 11/1978 | Grip | D9/44 |
| 2,952,374 | 9/1960 | Pryale | 215/329 |
| 3,159,298 | 12/1964 | Shaw | 215/228 |
| 3,231,155 | 1/1966 | McConnell . | |
| 3,321,096 | 5/1967 | Hebel | 215/1 R |
| 3,402,844 | 9/1968 | Chin | 215/100.5 |
| 3,888,373 | 6/1975 | Gach et al. | 215/214 |
| 4,010,860 | 3/1977 | Garber | 215/1 R |
| 4,098,419 | 7/1978 | Virog, Jr. et al. | 215/329 X |
| 4,273,247 | 6/1981 | Earls | 215/228 |
| 4,273,248 | 6/1981 | Lehmann | 215/334 X |
| 4,301,937 | 11/1981 | von Hagel | 215/252 |
| 4,322,012 | 3/1982 | Conti | 215/344 |

FOREIGN PATENT DOCUMENTS

| | | | |
|---|---|---|---|
| 995702 | 6/1955 | France . | |
| 7700326 | 8/1978 | France . | |
| 318869 | 9/1929 | United Kingdom | 215/329 |

*Primary Examiner*—Steven M. Pollard
*Attorney, Agent, or Firm*—Charles J. Zeller

[57] ABSTRACT

A container having an overcap, which container is adapted for closure by rotatable attachment of the overcap through a quarter-turn, the container comprising a container body having a neck, said neck having a pair of discontinuous threads describing, in opposed quadrants, arcs of about 90°, and a removable overcap having a planar top surface and an ovate skirt and having a cap member extending downwardly from said planar top surface, said cap member being provided with a pair of discontinuous threads describing in opposed aspect arcs of about 180°, said cap member threads being adapted for engagement with the threads of the neck, whereby the container is closed by placement of the cap member on the neck as to provide engagement of the terminal ends of the threads of the neck and of the cap member, the major axis of the overcap being normal to the major axis of the container body, and rotating the overcap one quarter-turn, said ovate skirt of the cap being brought into substantial alignment with the ovate container body thereby.

18 Claims, 8 Drawing Figures

BOTTLE

FIELD OF INVENTION

The present invention relates to a bottle or container that is adapted for closure by rotatable attachment of the cap through a quarter-turn. More specifically, the invention relates to such a container having a neck, the neck having a pair of discontinuous threads describing, in opposed quadrants, arcs of about 90°, and a container closure cap having a pair of discontinuous threads adapted for engagement with the threads provided on the neck. Most specifically, the present invention relates to a container of the type described above, which container has an ovate configuration as viewed from the top, the cap therefor having an ovate skirt, said cap being securable to the container body by positioning the cap on the neck of the bottle such that the major axes of the container body and the skirt are normal one to the other and rotating the cap a quarter-turn, thereby aligning the major axes of the container body and the skirt.

BACKGROUND OF THE INVENTION

Containers having threaded neck portions adapted to receive various closure caps are, of course, well known. Such containers come in a variety of shapes, and the closure caps may be provided with a peripheral skirt portion ask to give the container a symmetrical, smooth, uninterrupted appearance. Thus, for example, U.S. Pat. Nos. Des. 176,226 to Morris, Des. 223,438 to Lluch, Des. 244,176 to Pardo, Des. 235,032 to Atkins, and Des. 250,248 to Grip, each disclose designs of bottles or containers having a closure cap adapted to provide the container with greater aesthetic appeal.

Closure means wherein the cap includes a skirt portion are also disclosed in U.S. Pat. Nos. 4,273,247 to Earls, 4,322,012 to Conti, and 3,888,373 to Gach, et al., and French Pat. No. 77 00326.

The Gach, et al., patent relates to a child-resistant closure which includes an outer skirt, an intermediate skirt, and an inner skirt, the inner skirt being engaged within the container neck to form a first seal. A plurality of concentric members depend from the container cap and engage the top of the container neck to form a second seal, there being an integral annular sealing ring positioned between the intermediate skirt and the container to form a third seal.

The bottle cap disclosed in Conti has a first annular sealing flange engaging the internal wall surface of the bottle and a second annular sealing flange engaging the top surface of the bottle neck, said second flange being constructed with a flexible tip that flexes relative to the remaining portion of said second flange as it is engaged by the top of the bottle neck to produce a flapper-type seal.

The Earls patent concerns a bottle closure-cup assembly for use with a bottle having a rotatably removable cap. The assembly includes a cap having an inner cylindrical collar extending from the cup base and spaced apart from the top wall. The collar includes a plurality of inwardly facing axial ribs with a plurality of transverse-retaining lugs for engaging the cap. The cup and cap may be rotatably displaced as a unit, or, if desired, the cup may be separated from the cap while the cap remains on the bottle, by pulling the cup upwardly away from the bottle. The cap may then be removed separately from the bottle.

The French patent is similar to the Gach, et al., patent, except that there is provided in the neck of the bottle of the French patent a metering device adapted to regulate the dispensing of liquid from the bottle body.

U.S. Pat. No. 3,231,155 to McConnel discloses a container and closure cap therefor, the cap being fixedly rotatably positioned by means of lugs extending inwardly from the cap and being rotatable with slots provided in the neck of the container. The closure cap is adapted for rotation 90° from an open to a closed position, an orifice being exposed in the open position.

U.S. Pat. Nos. Re. 31,496 to Keeler and 4,301,937 to von Hagel are also of interest as illustrating tamper-resistant closure caps. U.S. Pat. No. 2,952,374 to Pryale discloses a sealing apparatus having multiple sealing surfaces wherein one of said surfaces is angularly inclined to the direction of sealing movement as between a screw cover and container. U.S. Pat. No. 3,402,844 discloses a catsup bottle having a base member adapted to function as a cap, thereby allowing for inversion of the bottle.

SUMMARY OF INVENTION

It is an object of the present invention to provide a container having a removable closure cap, the cap being fastened to the neck of the bottle by rotation of a quarter-turn.

It is a further object of the invention to provide a closure cap suitable for use with ovate containers.

It is a primary object of the present invention to provide an ovate container having a neck portion and a closure cap having an ovate skirt, the major axis of the container and the skirt being in alignment when the bottle is in closed position, said cap being rotatably securable to the neck by rotation within one quarter-turn.

It is an additional object of the present invention to provide a container that may be stored in inverted position.

These and other objects of the present invention are readily seen by reference to the accompanying drawings and upon reading of the detailed disclosure, a summary of which follows.

The present invention is drawn to a container having a cap, which container is adapted for closure by rotatable attachment of the cap through a quarter-turn. The container comprises a container body having a neck, the neck having a pair of discontinuous threads describing, in opposed quadrants, arcs of about 90°, and a container closure cap having a pair of discontinuous threads adapted for engagement with the threads provided on the neck. In a preferred embodiment, the container is ovate in configuration as viewed from the top, the top surface of the container body having a raised portion from which the neck of the container extends, the cap having an ovate skirt, the major axis of said ovate skirt being in alignment with the major axis of the container body when the cap is in closed position.

DESCRIPTION OF THE PREFERRED EMBODIMENT

Figure 2:
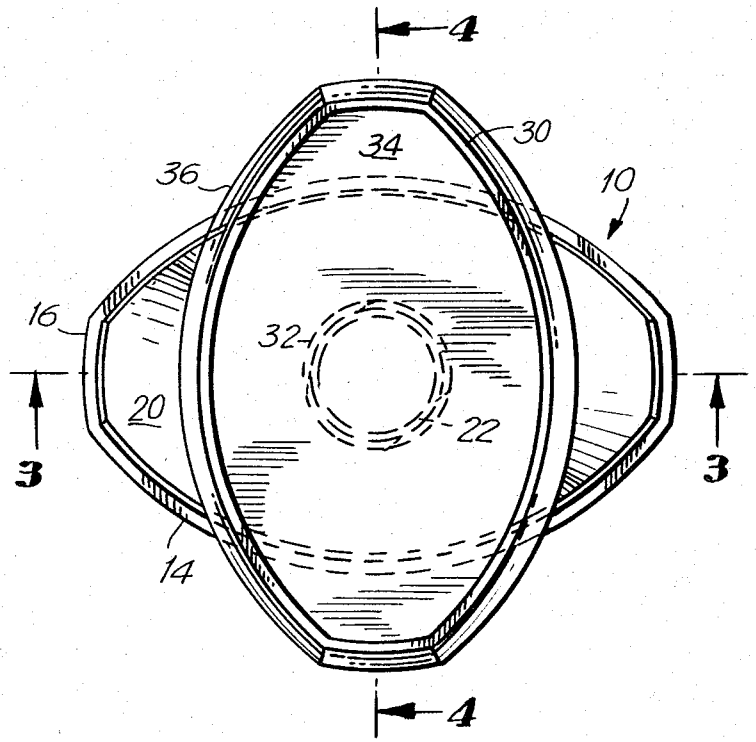
FIG. 2 is a top elevational view of the container shown in FIG. 1, with the cap in position for closing by rotation thereof.
Figure 1:
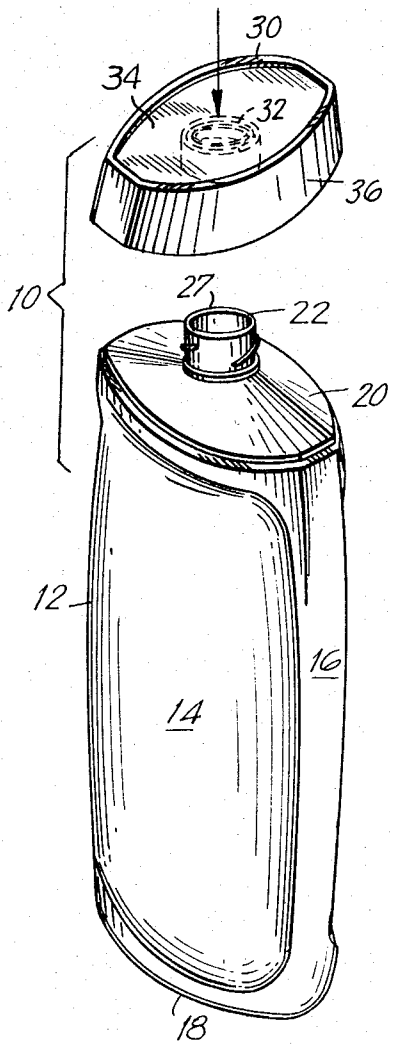
FIG. 1 is an exploded perspective view of an ovate container of the present invention, the major axis of the ovate skirt of the cap being normal to the major axis of the container body.

Referring to FIG. 1, the container 10 of the present invention comprises a container body 12 of ovate configuration, the container body having longitudinal side walls 14, transverse side walls 16, a base 18, and a top surface 20, a neck 22 extending from said top surface 20, and an overcap 30 having a cap member 32, an extended planar top portion 34, and an ovate skirt 36, the configuration of the skirt 36 being adapted when in closed position to superpose the periphery of the top surface 20 of the container body 12. FIG. 2 is a top plan view of the container 10 wherein the overcap 30 is loosely attached to the neck 22 of the container body 12, as described in more detail below, the major axis of the ovate skirt being normal to the major axis of the ovate container body 12. Clockwise rotation of the overcap 30 a quarter-turn closes the container 10, the major axes of the skirt 36 and the container body 12 then being in substantial alignment.

Figure 3:
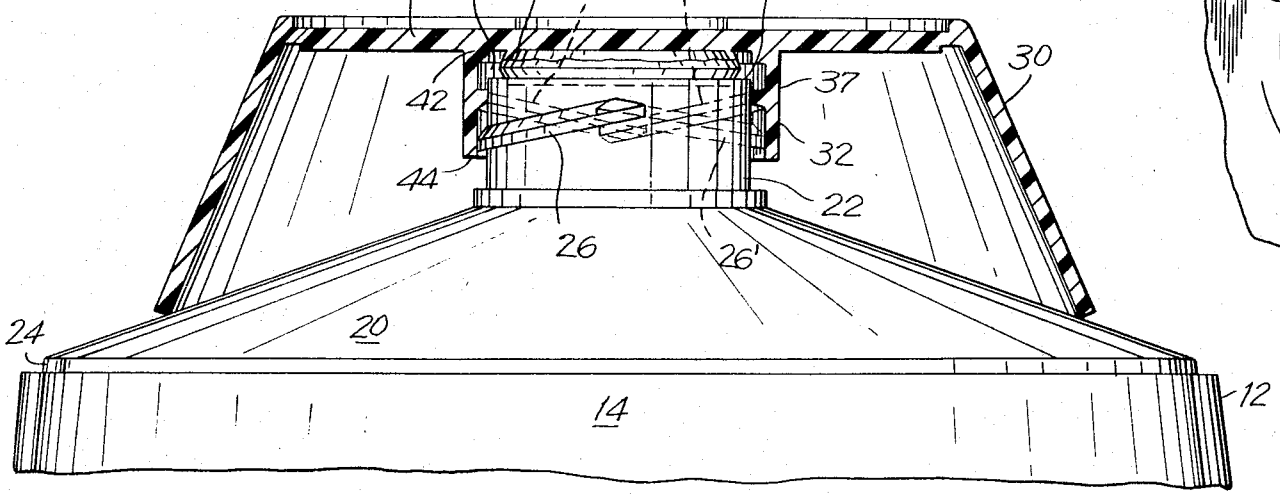
FIG. 3 is a cross-sectional view of the top portion of the container through lines 3—3 of FIG. 2.

Referring to FIG. 3, a cross sectional view through line 3—3 of FIG. 2, it is seen that the top surface 20 of the container body 12 has a peripheral lip 24, said top surface 20 being in the shape of an elliptical frustrum from the top of which the neck 22 extends upwardly. The lowermost portion of the neck 22 is provided with an annular collar 25, provided for reinforcement. A pair of threads 26,26' are provided on the exterior surface of the neck, which threads are about 90° in arcuate length and extend peripherally downwardly from proximate the top edge 27 of the neck 22 from proximate the transverse center line of the container body to proximate the longitudinal center line of the container body proximate the collar 25. Preferably, the threads 26,26' extend past each of the center lines of the container body slightly.

The cap member 32 is a hollow cylindrical member having a side wall 37, which side wall is provided on its interior surface with a pair of threads 38,38', and an extended top planar portion 34 from which extends a skirt member 36 along the periphery thereof. The cylindrical side wall 37 extends from the top planar surface 34 and is integral therewith. Also extending from the top planar surface 34 is a short cylindrical side wall 39 interior of the side wall 37, thereby providing an annular space 41. Within the annular space, there is provided adjacent the side wall 37 an annular lip 42. In the closed position, as most clearly seen in FIGS. 7 and 8, the top edge 27 of the neck 22 is received within the annular space 41 and abuts the annular lip 42, the short cylindrical side wall 39 extending into the interior of the neck 22.

Figure 5:
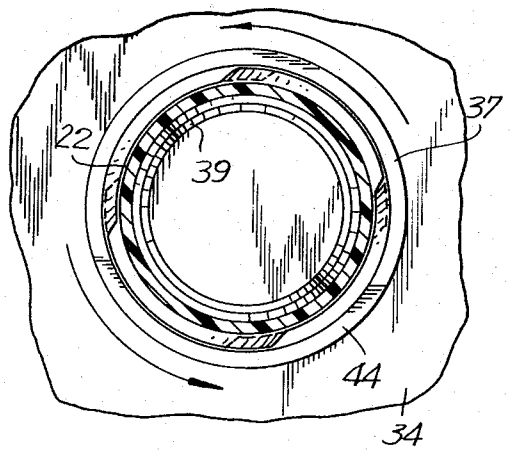
FIG. 5 is a detailed cross-sectional view of the neck portion of the container through lines 5—5 of FIG. 4.
Figure 4:
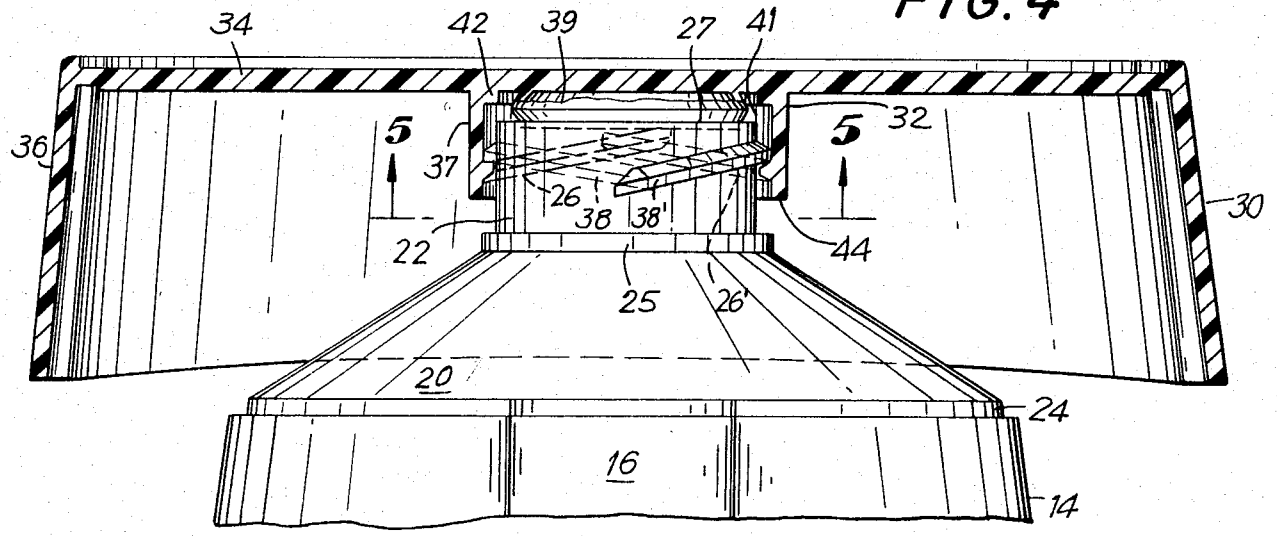
FIG. 4, is a cross-sectional view of the top portion of the container through lines 4—4 of FIG. 2.

The threads 38,38' describe an arc of approximately 180°, the threads 38,38' commencing proximate the lower edge 44 of the cylindrical side wall 37 and at the longitudinal center line of the skirt 34. Preferably, the threads 38,38' extend at their most interior portions slightly past the longitudinal center line and terminate proximate the top planar portion 34. As shown in FIG. 3, when the cap 30 is positioned on the container body 12, as shown in FIG. 2, the top portions of the terminal ends of the threads 38,38' proximate edge 44 engage by snap engagement the bottom portions of the terminal ends of the threads 26,26' proximate the edge 27, the threads 38,38' thus residing beneath the threads 26,26'. FIG. 4 is a further illustration of this loose-fit connection through lines 4—4 of FIG. 2, while FIG. 5 is a detailed cross-sectional view of the neck portion of the container 10 through lines 5—5 of FIG. 4.

After placement of the overcap 30 onto the neck 22 in this fashion, as shown in FIGS. 2-5, that is, as to provide snap engagement of the threads 26, 38 and 26', 38', rotation of the overcap 30 one quarter-turn closes the container, the major axis of the ovate skirt being brought into alignment with the major axis of the container body. At the onset of rotation slight pressure on the overcap may be necessary to retain the overcap 30 in position on the neck 22.

Figure 7:
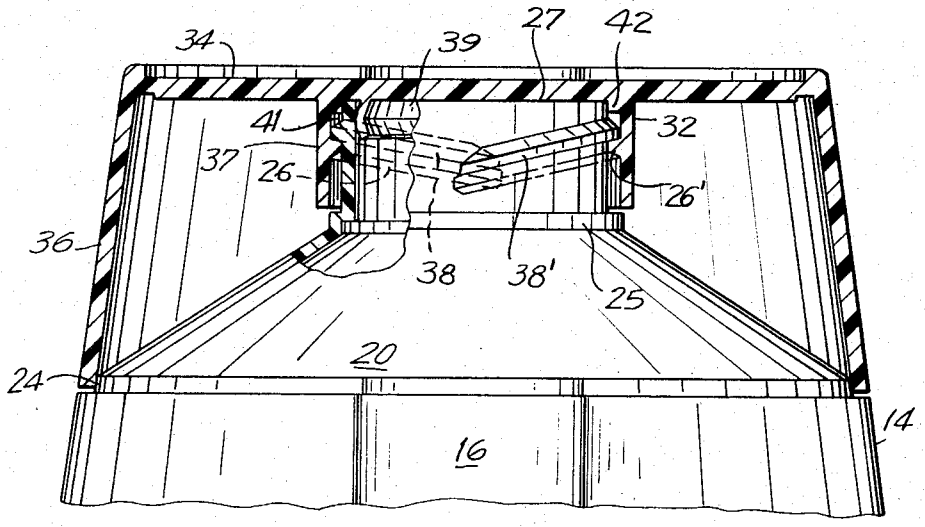
FIG. 7 is a cross-sectional view of a portion of the container in closed position through lines 7—7 of FIG. 6.
Figure 6:
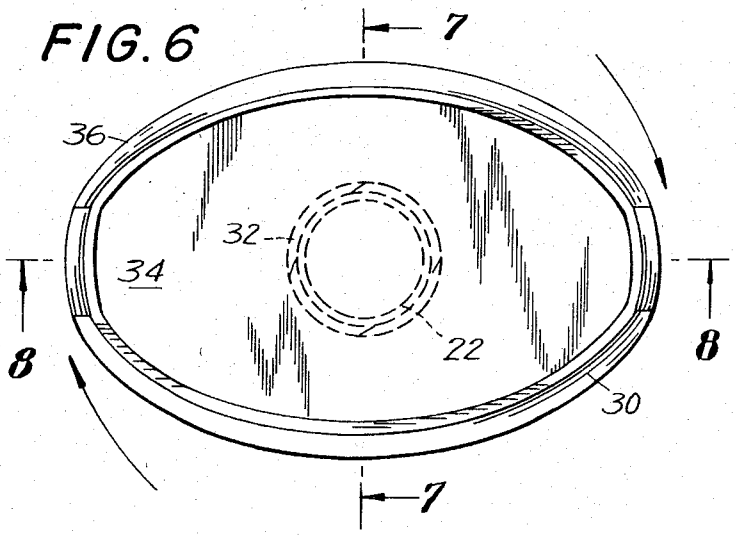
FIG. 6 is a top plan view of the container in closed position.
Figure 8:
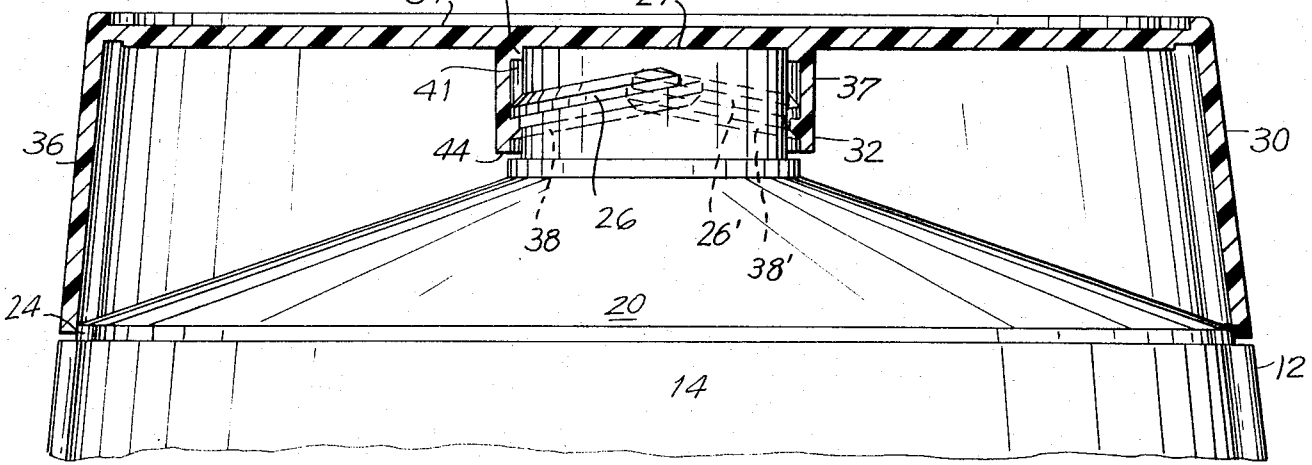
FIG. 8 is a cross-sectional view of a portion of the container in closed position through lines 8—8 of FIG. 6.

FIG. 6 illustrates the container in closed position as viewed from the top. Referring to FIGS. 7 and 8, it is seen that the skirt portion 34 is within the peripheral lip 24, thereby giving the container 10 a neat, streamlined appearance. The edge 44 of the cylindrical side wall 37 is proximate to the peripheral shoulder 25 in this closed position, while the topmost portion of the container neck 22 resides within the annular channel 41 adjacent the annular lip 42. The short cylindrical side wall 39 is within the neck 22, thereby providing a positive seal of the container 10.

While the present invention has been described with respect to the preferred embodiment, it should be obvious to those skilled in the art that other embodiments can be visualized without departing from the spirit and scope of the invention.

We claim:

1. A container having an overcap, which container is adapted for closure by rotatable attachment of the overcap through a quarter-turn, the container comprising an ovate container body having a centrally disposed neck, the neck having a pair of discontinuous threads describing, in opposed quadrants, arcs of about 90°, and a removable overcap having a planar top surface and an exterior ovate skirt and having a cap member extending downwardly from said planar top surface, said cap member being provided with a pair of discontinuous threads adapted for engagement with the threads provided on the neck, whereby the container is closed by placement of the cap member on the neck as to provide engagement of the terminal ends of the threads of the neck and of the cap member and rotating the overcap one quarter-turn, the ovate exterior skirt being brought into substantial alignment with the ovate container body thereby.

2. The container of claim 1 wherein the cap member is integral with the planar top surface of the overcap.

3. The container of claim 2 wherein the threads in the centrally disposed neck are exterior thereof, and wherein the cap member is a hollow cylindrical member provided with threads interior thereof.

4. The container of claim 3 wherein the cap member further comprises a short cylindrical side wall interior the hollow cylindrical member to define an annular space therebetween, the neck of the container body being received thereby in closed position.

5. The container of claim 3 wherein the neck threads describe an arc slightly greater than 90°.

6. The container of claim 3 wherein the cap member threads describe an arc of about 180°.

7. A container having an overcap, which container is adapted for closure by rotatable attachment of the overcap through a quarter-turn, the container comprising an ovate container body having a top surface and a neck, said top surface having a raised interior portion from which the neck extends, said neck having a pair of discontinuous threads describing, in opposed quadrants, arcs of about 90°, and a removable overcap having a planar top surface and an ovate skirt and a cap member extending downwardly from said planar top surface, said cap member being provided with a pair of discontinuous threads describing, in opposed aspect, arcs of about 180°, said cap member threads being adapted for engagement with the threads of the neck, whereby the container is closed by placement of the cap member on the neck as to provide engagement of the terminal ends of the threads of the neck and of the cap member, the major axis of the overcap being normal to the major axis of the container body, and rotating the overcap one quarter-turn, said ovate skirt of the overcap being brought into substantial alignment with the ovate container body thereby.

8. The container of claim 7 wherein the cap member is integral to the planar top surface of the overcap.

9. The container of claim 7 wherein the threads in the neck are exterior thereof, and wherein the cap member is a hollow cylindrical member provided with threads interior thereof.

10. The container of claim 9 wherein the cap member further comprises a short cylindrical side wall interior the hollow cylindrical member to define an annular space therebetween, the neck of the container body being received thereby in closed position.

11. The container of claim 10 wherein the cap member threads commence proximate the lower edge of the hollow cylindrical member and at about the centerline of the major axis of the overcap, and wherein the neck threads commence proximate the top edge of the neck and at about the centerline of the minor axis of the container body, and terminate proximate the top surface of the container body.

12. The container of claim 7 wherein a lip is provided in the periphery of the top surface of the container body.

13. A container having an overcap, which container is adapted for closure by rotatable attachment of the overcap through a quarter-turn, the container comprising a noncircular container body having a centrally disposed neck, the neck having a pair of discontinuous threads describing, in opposed quadrants, arcs of about 90°, and a removable overcap having a planar top surface and an exterior skirt, the skirt configuration being substantially geometrically similar to that of the container body, said overcap member extending downwardly from said planar top surface, said cap member being provided with a pair of discontinuous threads describing, in opposed aspect, arcs of about 180°, said cap member threads being adapted for engagement with the threads of the neck, whereby the container is closed by placement of the cap member on the neck as to provide engagement of the terminal ends of the threads of the neck and of the cap member, and rotating the overcap one-quarter-turn, said skirt of the overcap being brought into substantial alignment with the container body thereby.

14. The container of claim 13 wherein the cap member is integral to the planar top surface of the overcap.

15. The container of claim 13 wherein the threads in the neck are exterior thereof, and wherein the cap member is a hollow cylindrical member provided with threads interior thereof.

16. The container of claim 15 wherein the cap member threads commence proximate the lower edge of the hollow cylindrical member proximate a center line of the overcap, said threads extending upwardly towards the top planar surface of the overcap, and wherein the neck threads commence proximate the top edge of the neck proximate the other center line of the container body, and terminate proximate the top surface of the container body, whereby closure of the cap member one-quarter-turn causes the top edge of the neck to abut the planar top surface of the overcap.

17. The container of claim 16 wherein the cap member further comprises a short cylindrical sidewall interior the hollow cylindrical member to define an annular space therebetween, the neck portion of the container body being received thereby in closed position.

18. The container of claim 17 wherein a lip is provided in the periphery of the top surface of the container body.

* * * * *